US011670279B2

(12) United States Patent
Yan et al.

(10) Patent No.: US 11,670,279 B2
(45) Date of Patent: Jun. 6, 2023

(54) METHOD FOR REDUCING NOISE, STORAGE MEDIUM, CHIP AND ELECTRONIC EQUIPMENT

(71) Applicant: Shenzhen Bluetrum Technology Co., Ltd., Guangdong (CN)

(72) Inventors: Zhangyi Yan, Guangdong (CN); Jinhong Lin, Guangdong (CN); Zhen Wang, Guangdong (CN)

(73) Assignee: Shenzhen Bluetrum Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/893,220

(22) Filed: Aug. 23, 2022

(65) Prior Publication Data

US 2023/0077311 A1 Mar. 9, 2023

(30) Foreign Application Priority Data

Aug. 23, 2021 (CN) ..... 202110969638.6

(51) Int. Cl.
*H04R 1/10* (2006.01)
*H04R 3/00* (2006.01)
*G10K 11/178* (2006.01)

(52) U.S. Cl.
CPC ..... *G10K 11/17854* (2018.01); *H04R 1/1083* (2013.01); *H04R 3/005* (2013.01); *H04R 2460/13* (2013.01)

(58) Field of Classification Search
CPC ..... H04R 1/10; H04R 1/1083; H04R 3/00; H04R 3/005; H04R 3/04; H04R 3/10; H04R 2460/01; H04R 2460/13; G10K 11/16; G10K 11/178; G10K 11/1781; G10K 11/17853; G10K 11/17854
See application file for complete search history.

(56) References Cited

U.S. PATENT DOCUMENTS 9,812,147 B2 * 11/2017 Kechichian ..... G10L 21/0208
10,219,063 B1 2/2019 Valenzuela et al.
10,332,541 B2 * 6/2019 Erkelens ..... G10L 25/12
2010/0310084 A1 * 12/2010 Hersbach ..... H04R 25/453 381/71.6

(Continued)

FOREIGN PATENT DOCUMENTS

CN 109767783 A 5/2019
CN 110265056 A 9/2019

(Continued)

OTHER PUBLICATIONS

KR 10-1662946 B1 English Translation, Kang H, Dated Oct. 2016.*

(Continued)

*Primary Examiner* — Thang V Tran

(57) ABSTRACT

A method for reducing noise includes: obtaining a priori signal-to-noise ratio of air-bone integration, the priori signal-to-noise ratio of air-bone integration being obtained by integrating air conduction parameters of the current frame, bone conduction parameters of the current frame and air conduction noise parameters of the current frame; calculating a noise reduction gain according to the priori signal-to-noise ratio of air-bone integration; and performing noise reduction operation according to the noise reduction gain and the air conduction parameters of the current frame.

19 Claims, 10 Drawing Sheets

(56) References Cited

U.S. PATENT DOCUMENTS

| | | | | |
|---|---|---|---|---|
| 2014/0363020 | A1* | 12/2014 | Endo | G10L 21/0208 381/98 |
| 2020/0105287 | A1* | 4/2020 | Chang | G06N 3/0454 |
| 2021/0243523 | A1* | 8/2021 | Hui | H04B 1/385 |
| 2022/0208207 | A1* | 6/2022 | Zheng | G10L 21/0232 |

FOREIGN PATENT DOCUMENTS

| | | | | |
|---|---|---|---|---|
| CN | 110931031 | A | 3/2020 | |
| CN | 112017696 | A * | 12/2020 | G10L 25/84 |
| EP | 2811485 | A1 | 12/2014 | |
| KR | 1662946 | B1 * | 10/2016 | G10L 21/0208 |
| WO | WO-2012069973 | A1 * | 5/2012 | H04R 29/00 |

OTHER PUBLICATIONS

CN-112017696-A English Translation, Chen G, Dated Dec. 2020.*
Notice of Allowance of counterpart Chinese Patent Application No. 202110969638.6 dated Oct. 12, 2021.

* cited by examiner

METHOD FOR REDUCING NOISE, STORAGE MEDIUM, CHIP AND ELECTRONIC EQUIPMENT

CROSS-REFERENCE TO RELATED APPLICATIONS

The present disclosure claims priority of Chinese Patent Application No. 202110969638.6, filed on Aug. 23, 2021, titled "method for reducing noise, storage medium, chip and electronic equipment", the contents of which are incorporated herein by reference.

TECHNICAL FIELD

The present disclosure relates to the technical field of noise reduction, and in particular, relates to a method for reducing noise, a storage medium, a chip and an electronic equipment.

BACKGROUND

With the continuous development of mobile voice communication, it is very important to keep the intelligibility, reliability and audibility of voice in noisy environment. There are too many limitations in conventional noise reduction algorithms based on single channel air conduction microphone, e.g., in the case of low signal-to-noise ratio, the voice is easily distorted.

Bone conduction microphones are not affected by environmental noise due to physical sensing characteristics thereof, so the dual-microphone noise reduction method based on bone conduction microphones and air conduction microphones is a preferred choice. The conventional dual-microphone noise reduction method usually uses the bone conduction low-frequency part to directly compensate for the low-frequency part of the air conduction microphone signal. Such a practice results in obvious feeling of switching, which causes hearing discomfort.

SUMMARY

An embodiment of the present disclosure provides a method for reducing noise. The method includes: obtaining a priori signal-to-noise ratio of air-bone integration, the priori signal-to-noise ratio of air-bone integration being obtained by integrating air conduction parameters of the current frame, bone conduction parameters of the current frame and air conduction noise parameters of the current frame; calculating a noise reduction gain according to the priori signal-to-noise ratio of air-bone integration; and performing noise reduction operation according to the noise reduction gain and the air conduction parameters of the current frame.

BRIEF DESCRIPTION OF THE DRAWINGS

One or more embodiments are illustrated by pictures in corresponding attached drawings, and this does not constitute limitation of the embodiments. Elements labeled with the same reference numerals in the attached drawings represent similar elements, and unless otherwise stated, figures in the attached drawings do not constitute scale limitation.

DETAILED DESCRIPTION

In order to make objects, technical solutions and advantages of the present disclosure clearer, the present disclosure will be further described in detail with reference to attached drawings and embodiments. It shall be appreciated that, the specific embodiments described herein are only used to explain the present disclosure, and are not used to limit the present disclosure. Based on the embodiments of the present disclosure, all other embodiments obtained by those of ordinary skill in the art without creative labor belong to the scope claimed in the present disclosure.

It shall be noted that, all features in the embodiments of the present disclosure can be combined with each other if there is no conflict, and all the combination are within the scope claimed in the present disclosure. In addition, although functional modules are divided in the schematic diagrams of the device and logical sequences are shown in the flowchart diagrams, in some cases, the steps shown or described can be performed in module division and sequences different from those in the schematic diagrams and flowchart diagrams. Furthermore, words such as "first", "second" and "third" used in the present disclosure do not limit the data and execution order, but only distinguish same or similar items with basically the same functions and effects.

An embodiment of the present disclosure provides a method for reducing noise, and the method may be applied to any suitable type of electronic equipments, such as earphones, mobile phones, smart watches, tablet computers, pagers, loudspeaker boxes or the like. When the electronic equipments are earphones, the earphones may include in-ear headsets, headphones or ear-hanging earphones or the like.

Figure 1:
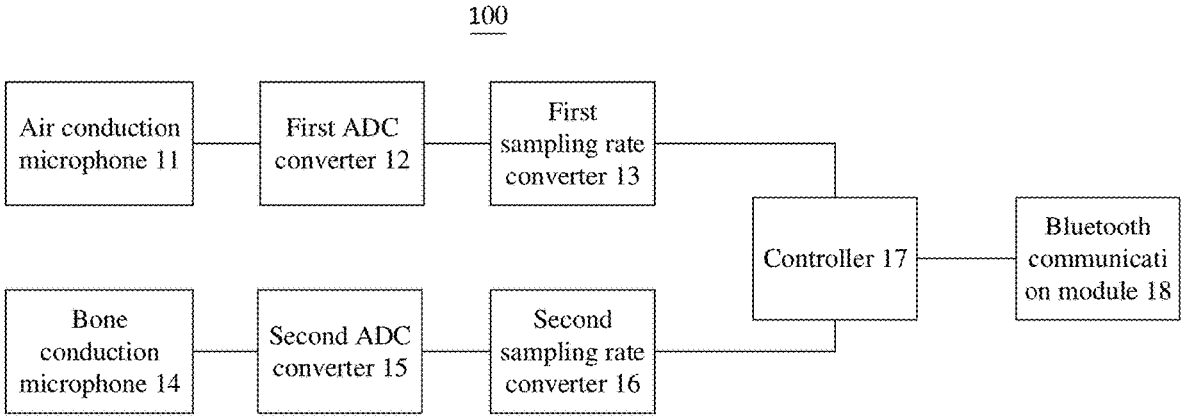
FIG. 1 is a schematic view of a circuit structure of an earphone provided according to an embodiment of the present disclosure.

Referring to FIG. 1, the earphone 100 includes an air conduction microphone 11, a first ADC converter 12, a first sampling rate converter 13, a bone conduction microphone 14, a second ADC converter 15, a second sampling rate converter 16, a controller 17 and a Bluetooth communication module 18.

The air conduction microphone 11 is used for collecting air conduction sound signals, which are sound signals transmitted by air as a transmission medium, wherein the air conduction sound signals may be sound signals with environmental noise or pure sound signals.

The first ADC converter 12 is used for converting the air conduction sound signal into a digital signal, and according to the sampling rate, the first sampling rate converter 13 collects the digital signal to obtain an air conduction signal.

The bone conduction microphone 14 is used for collecting bone conduction sound signals, which are sound signals transmitted by a human body part such as bone as a transmission medium, wherein the bone conduction sound signals may be sound signals with electrical noise or pure sound signals.

The second ADC converter 15 is used for converting the bone conduction sound signal into a digital signal, and according to the sampling rate, the second sampling rate converter 16 collects the digital signal to obtain a bone conduction signal.

In some embodiments, the sampling rate of the second ADC converter 15 is the same as that of the first ADC converter 12.

The controller 17 performs noise reduction in combination with the noise reduction method described below according to the air conduction signal and the bone conduction signal so as to obtain the noise-reduced voice information.

The Bluetooth communication module 18 performs Bluetooth communication with external equipments under the control of the controller 17, wherein the controller 17 may transmit the noise-reduced voice information to the Bluetooth communication module 18, and the Bluetooth communication module 18 then sends the noise-reduced voice information to the external equipments.

Figure 2:
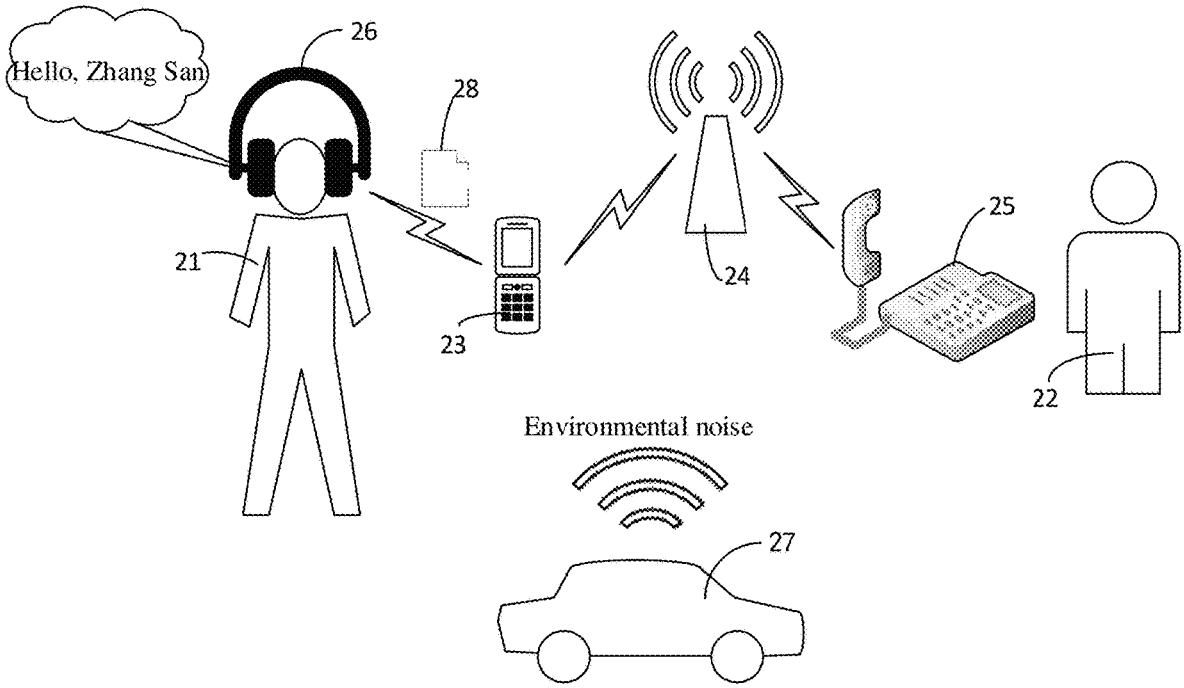
FIG. 2 is a schematic view of a noise reduction scene of an earphone provided according to an embodiment of the present disclosure.

Referring to FIG. 2, a user 21 talks with a user 22 on the phone, wherein a mobile phone 23 of the user 21 establishes a communication connection with a phone 25 of the user 22 through a base station 24.

The user 21 wears an earphone 26, and the earphone 26 establishes Bluetooth communication with the mobile phone 23. The earphone 23 is provided with an air conduction microphone 11 and a bone conduction microphone 14, and the user 21 generates a sound signal "Hello, Zhang San". On the one hand, this sound signal is transmitted to the air conduction microphone 11 through air and collected by the air conduction microphone 11, and at the same time, the air conduction microphone 11 may also collect the environmental noise generated by an automobile 27. On the other hand, this sound signal may also be transmitted to the bone conduction microphone 14 through human body parts such as bone of the user 21 and collected by the bone conduction microphone 14.

The controller 17 performs noise reduction according to the air conduction signal and the bone conduction signal to obtain the noise-reduced voice information 28, and controls the Bluetooth communication module 18 to send the noise-reduced voice information 28 to the mobile phone 23. The mobile phones 23 transmits the noise-reduced voice information 28 to the base station 24, the base station 24 then forwards the noise-reduced voice information 28 to the phone 25, so that the user 22 can hear the noiseless or low-noise voice information on the phone 25.

Before describing the noise reduction method provided according to the embodiment of the present disclosure, a noise reduction method discovered by the inventor in the process of realizing the present disclosure is first described briefly herein. It first calculates a priori signal-to-noise ratio, then calculates the noise reduction gain according to the priori signal-to-noise ratio, and finally performs noise reduction according to the noise reduction gain. It uses the Decision-Directed (DD) algorithm to calculate the priori signal-to-noise ratio, and the conventional DD algorithm is deduced as follows:

$$\widehat{\xi_a}(\ell,k)=a\cdot\widehat{\xi_{a1}}(l-1,k)+(1-a)\cdot\widehat{\xi_{a2}}(\ell,k) \quad \text{Equation 1}$$

wherein $\widehat{\xi_a}(\ell,k)$ is the priori signal-to-noise ratio of the kth frequency point in the $\ell$th frame, $\ell$ is the frame index, k is the frequency point index, $0\le k\le N$, N is the total number of frequency points, a is the recursive factor which generally ranges from 0.92 to 0.99.

$$\widehat{\xi_{a1}}(\ell-1,k)=|G(\ell-1,k)\cdot Y(\ell-1,k)|^2/\widehat{\sigma_N^2}(\ell-1,k) \quad \text{Equation 2}$$

$$\widehat{\xi_{a2}}(\ell,k)=\max(|Y(\ell,k)|^2/\widehat{\sigma_N^2}(\ell,k)-1,0) \quad \text{Equation 3}$$

$|Y(\ell,k)|^2$ is the power parameter of the air conduction power spectrum corresponding to the kth frequency point in the lth frame, $\widehat{\sigma_N^2}(\ell,k)$ is the power parameter of the air conduction noise spectrum corresponding to the kth frequency point in the $\ell$th frame, $G(\ell,k)$ is the gain corresponding to the kth frequency point in the lth frame, $\widehat{\xi_{a1}}(\ell-1,k)$ is the priori signal-to-noise ratio of the kth frequency point in the $(\ell-1)$th frame, and $\widehat{\xi_{a2}}(\ell,k)$ is the maximum value between the value obtained by subtracting the natural number 1 from the posteriori signal-to-noise ratio of the kth frequency point in the lth frame and 0.

The recursive factor a adopted by the conventional DD algorithm is a fixed value, which cannot reach the statistical optimum. Therefore, generally an optimization method of the conventional DD algorithm is adopted to rewrite the Equation 1 into:

$$\widehat{\xi_{a2}}(\ell,k)=a_1(\ell,k)\cdot\ell(l-1,k)+(1-a_1(\ell,k))\cdot\widehat{\xi_{a2}}(\ell,k) \quad \text{Equation 4}$$

The minimum mean square error criterion is adopted:

$$D=E[|\xi_a(\ell,k)-\widehat{\xi_{a2}}(\ell,k)|^2] \quad \text{Equation 5}$$

$$\frac{\partial\mathcal{D}}{\partial a_1(\ell,k)}=0 \quad \text{Equation 6}$$

The equations (5) and (6) are combined into:

$$a_1(\ell,k)=\frac{1}{1+\left(\frac{\xi_a(\ell,k)-\hat{\xi}_{a1}(\ell-1,k)}{\xi_a(\ell,k)}\right)^2} \quad \text{Equation 7}$$

Because $\widehat{\xi_{a2}}(l,k)$ is unknown, $\widehat{\xi_{a2}}(l,k)$ is generally used instead. As can be known from the above equation, as the error between $\widehat{\xi_{a2}}(l,k)$ and $\ell(l-1,k)$ increases and $\widehat{\xi_{a2}}(l,k)$ decreases, $a_1(l,k)$ tends to approach 0, and vice versa, $a_1(l,k)$ approaches 1. As can be known from Equation 3, the establishment of the DD algorithm is based on the assumption that human voice and noise are not related to each other. However, in noisy environments or some extreme environments, this assumption is obviously not valid, which will cause distortion of human voice or noise residue. Therefore, the introduction of bone conduction signal can compensate for the distortion of human voice or noise residue or the like caused by low signal-to-noise ratio of air conduction microphone.

Figure 3:
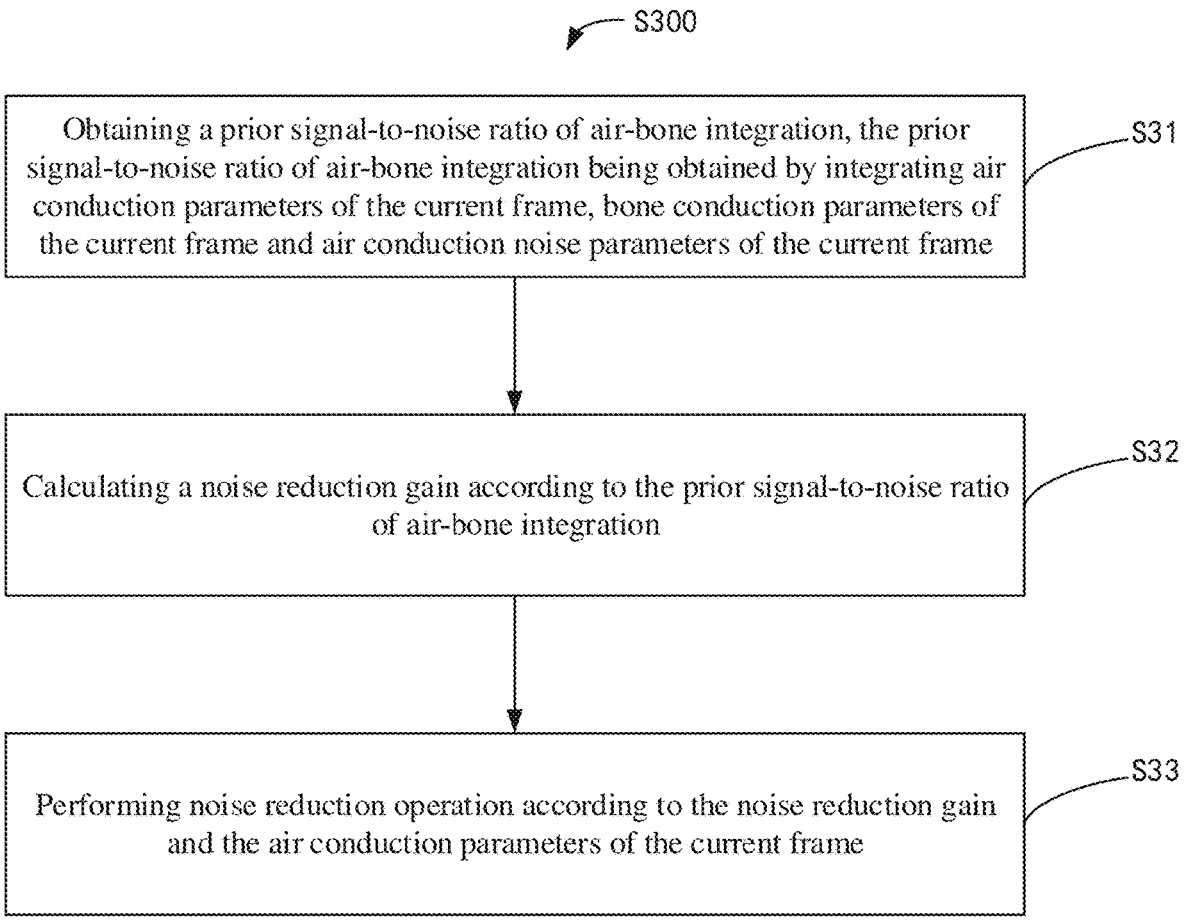
FIG. 3 is a schematic flowchart diagram of a noise reduction method provided according to an embodiment of the present disclosure.

An embodiment of the present disclosure provides a method of reducing noise, referring to FIG. 3, the method for reducing noise S300 includes:

S31: obtaining a priori signal-to-noise ratio of air-bone integration, the priori signal-to-noise ratio of air-bone integration is obtained by integrating air conduction parameters of the current frame, bone conduction parameters of the current frame and air conduction noise parameters of the current frame.

In some embodiments, the air conduction parameters of the current frame are the air conduction parameters of the current frame, wherein the air conduction parameters are parameters obtained from the air conduction sound signals collected by the air conduction microphone, and the earphone converts the air conduction sound signals into air conduction parameters according to the Fourier transform algorithm. In some embodiments, the air conduction parameters are air conduction frequency spectrum parameters or air conduction power spectrum parameters, the air conduction frequency spectrum parameters are frequency spectrum parameters of air conduction frequency spectrum, and the air conduction power spectrum parameters are power parameters of air conduction power spectrum.

In some embodiments, the air conduction noise parameters of the current frame are the air conduction noise parameters of the current frame, wherein the air conduction noise parameters are parameters of the air conduction noise spectrum, the air conduction noise spectrum may be extracted from the air conduction frequency spectrum or the air conduction power spectrum according to the noise extraction algorithm. The air conduction noise spectrum includes the air conduction noise frequency spectrum or the air conduction noise power spectrum, and correspondingly, the air conduction noise parameters include the frequency spectrum parameters of the air conduction noise frequency spectrum or the power parameters of the air conduction noise power spectrum.

In some embodiments, the earphone extracts the air conduction parameters of the current frame corresponding to each air conduction frequency point in the effective signal frequency range according to the sampling rate, determines the air conduction noise spectrum according to the air conduction parameters of the current frame, and determines the air conduction noise parameters of the current frame according to the air conduction noise spectrum, wherein the air conduction noise is mainly environmental noise.

In some embodiments, the bone conduction parameters of the current frame are bone conduction parameters of the current frame, wherein the bone conduction parameters are parameters obtained from the bone conduction sound signals collected by the bone conduction microphone, and the earphone converts the bone conduction sound signals into the bone conduction parameters according to the Fourier transform algorithm. In some embodiments, the bone conduction parameter is a bone conduction frequency spectrum parameter or a bone conduction power spectrum parameter, the bone conduction frequency spectrum parameter is a frequency spectrum parameter of the bone conduction frequency spectrum, and the bone conduction power spectrum parameter is a power parameter of the bone conduction power spectrum.

The priori signal-to-noise ratio of air-bone integration may vary with the changes of the air conduction parameters of the current frame, the bone conduction parameters of the current frame or the air conduction noise parameters of the current frame, because the priori signal-to-noise ratio of air-bone integration integrates the air conduction parameters of the current frame, the bone conduction parameters of the current frame and the air conduction noise parameters of the current frame.

S32: calculating a noise reduction gain according to the priori signal-to-noise ratio of air-bone integration.

In some embodiments, the noise reduction gain is the gain of reducing noise. In some embodiments, the earphone may calculate the noise reduction gain according to any suitable gain algorithm, and for example, the gain algorithm includes Wiener filtering algorithm or minimum mean square error algorithm or the like.

S33: performing noise reduction operation according to the noise reduction gain and the air conduction parameters of the current frame.

In some embodiments, when the air conduction parameter of the current frame is a frequency spectrum parameter, the earphone multiplies the noise reduction gain by the frequency spectrum parameter to obtain a noise-reduced signal, and the earphone outputs the noise-reduced signal to complete the noise reduction operation.

Because the priori signal-to-noise ratio of air-bone integration has integrated the air conduction parameters of the current frame, the bone conduction parameters of the current frame and the air conduction noise parameters of the current frame, this embodiment can adaptively track and reduce the noise according to the environmental noise by combining the priori signal-to-noise ratio of air-bone integration, so that the voice can be conveyed to the user more naturally without feeling of switching, thereby improving the user experience.

Figure 4:
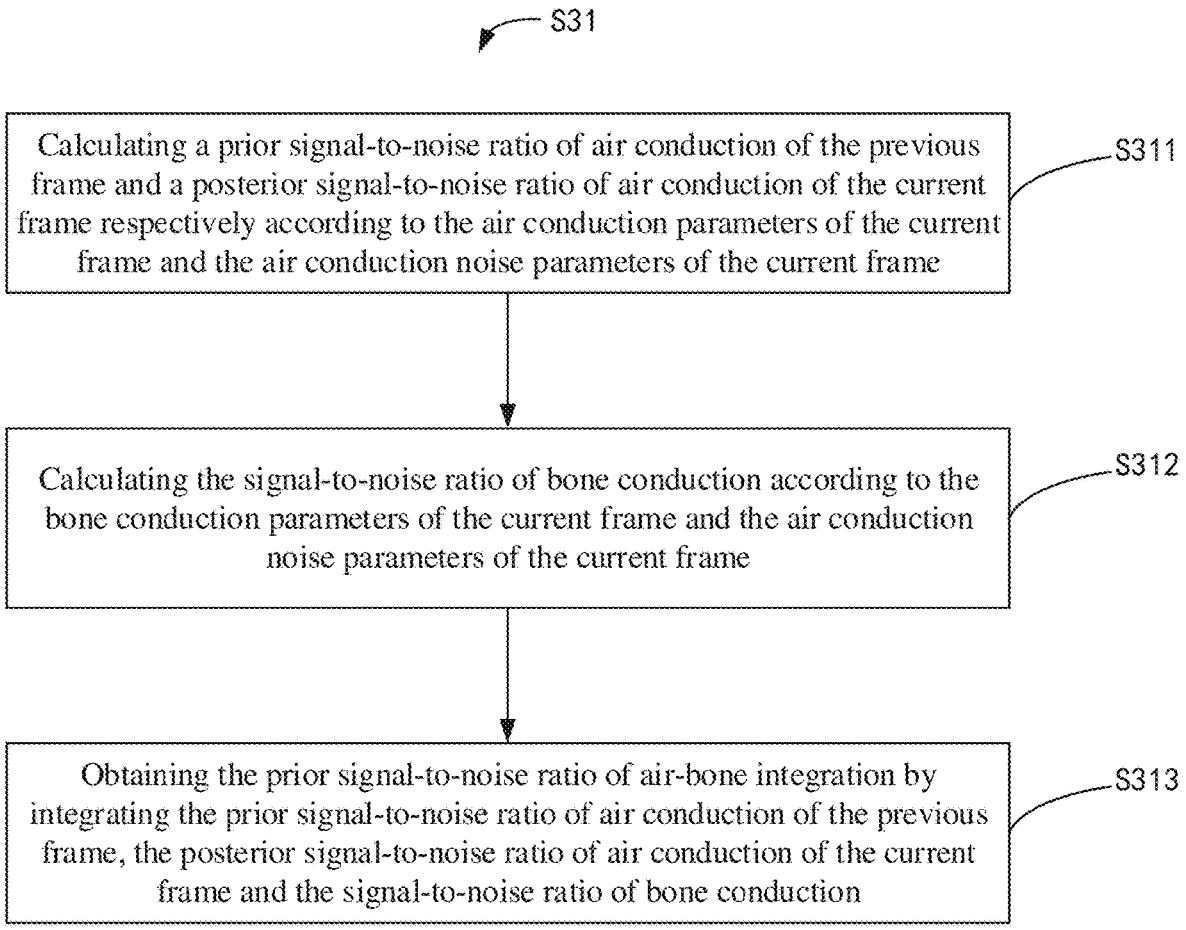
FIG. 4 is a schematic flowchart diagram of S31 shown in FIG. 3.

In some embodiments, in the operation of acquiring the priori signal-to-noise ratio of air-bone integration, referring to FIG. 4, S31 includes:

S311: calculating a priori signal-to-noise ratio of air conduction of the previous frame and a posteriori signal-to-noise ratio of air conduction of the current frame respectively according to the air conduction parameters of the current frame and the air conduction noise parameters of the current frame;

S312: calculating the signal-to-noise ratio of bone conduction according to the bone conduction parameters of the current frame and the air conduction noise parameters of the current frame;

S313: obtaining the priori signal-to-noise ratio of air-bone integration by integrating the priori signal-to-noise ratio of air conduction of the previous frame, the posteriori signal-to-noise ratio of air conduction of the current frame and the signal-to-noise ratio of bone conduction.

In some embodiments, the priori signal-to-noise ratio of air conduction of the previous frame is the priori signal-to-noise ratio of air conduction signal of which the frame number comes before the air conduction signal of the current frame. For example, the air conduction signal of the Ith frame is the air conduction signal of the current frame, the air conduction signal of the (I−1)th frame is the air conduction signal of the previous frame, and the priori signal-to-noise ratio of air conduction signal of the (I−1)th frame is the priori signal-to-noise ratio of air conduction of the previous frame. For another example, referring to Equation 1, $\ell(l-1,k)$ is the priori signal-to-noise ratio of air conduction of the previous frame, and $\widehat{\xi_{a2}}(l,k)$ is the priori signal-to-noise ratio of air conduction of the current frame.

In some embodiments, the earphone may obtain the air conduction parameters of the previous frame according to the air conduction parameters of the current frame, and obtain the air conduction noise parameters of the previous frame according to the air conduction noise parameters of the current frame. Then, the earphone calculates the priori signal-to-noise ratio of air conduction of the previous frame according to Equation 2.

In some embodiments, the posteriori signal-to-noise ratio of air conduction of the current frame is the posteriori signal-to-noise ratio of air conduction signal of the current frame. For example, referring to Equation 3, $|Y(l,k)|^2/\widehat{\sigma_N^2}(l,k)$ is the posteriori signal-to-noise ratio of air conduction signal of the current frame, and $\widehat{\xi_{a2}}(l,k)$ is the maximum value between the value obtained by subtracting natural number 1 from the posteriori signal-to-noise ratio of air conduction of the current frame and 0. In some embodiments, the earphone may calculate the posteriori signal-to-noise ratio of air conduction of the current frame according to Equation 3.

In some embodiments, the signal-to-noise ratio of bone conduction is the priori signal-to-noise ratio of the bone conduction signal of the current frame. For example, please refer to Equation 8 and Equation 9:

$$\hat{\psi}(\ell,k)=|\widehat{\sigma_N^2}(\ell,k)|^2/\widehat{\sigma_N^2}(\ell,k),\ 0<k\leq k_b \qquad \text{Equation 8}$$

$$\widehat{B_S}(\ell,k)=G_B(\ell,k)\cdot B(\ell,k) \qquad \text{Equation 9}$$

$B(\ell,k)$ is the frequency spectrum parameter of the bone conduction signal of the kth frequency point in the $\ell$th frame, $\widehat{B_S}(\ell,k)$ is the frequency spectrum parameter of the pure bone conduction signal of the kth frequency point in the $\ell$th frame, $G_B(l,k)$ is the gain of the bone conduction signal of the kth frequency point in the $\ell$th frame, $k_b$ is the upper limit of the frequency point of the bone conduction signal within the effective frequency range, and $\hat{\psi}(\ell,k)$ is the signal-to-noise ratio of bone conduction of the bone conduction signal of the kth frequency point in the lth frame.

In some embodiments, as can be known from the physical characteristics of the bone conduction signal, its effective signal range is 0 to 1000 Hz. Therefore, when using the bone conduction signal, $0<k\leq k_b$, k satisfies $$0<k\cdot\frac{fs}{N}\leq 1000,$$

and $f_s$ is the sampling rate.

In some embodiment, the priori signal-to-noise ratio of air-bone integration can be obtained by integrating the priori signal-to-noise ratio of air conduction of the previous frame, the posteriori signal-to-noise ratio of air conduction of the current frame and the signal-to-noise ratio of bone conduction, which can adaptively change with the air conduction signal and its noise signal, bone conduction signal and its noise so as to effectively reduce noise.

Figure 5:
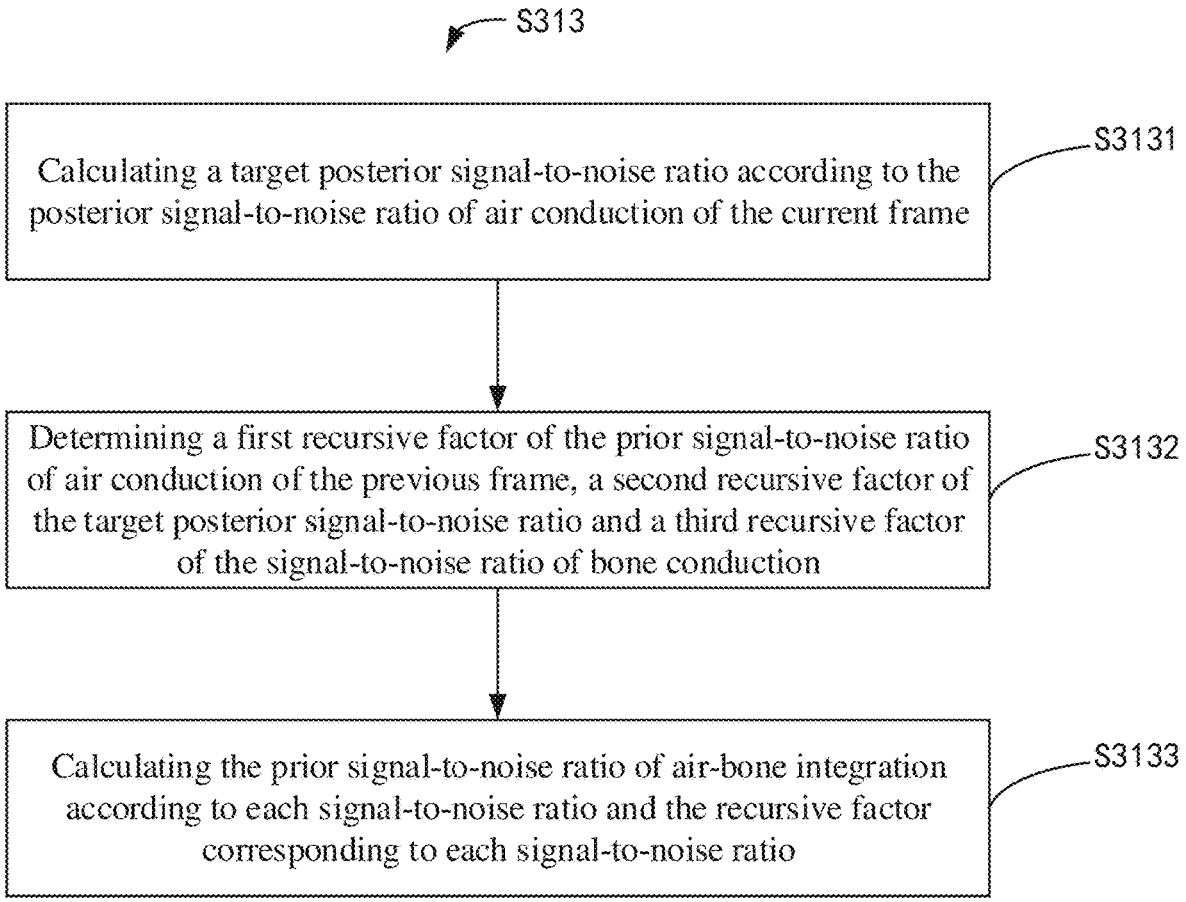
FIG. 5 is a schematic flowchart diagram of S313 shown in FIG. 4.

In some embodiments, referring to FIG. 5, S313 includes:

S3131: calculating a target posteriori signal-to-noise ratio according to the posteriori signal-to-noise ratio of air conduction of the current frame;

S3132: determining a first recursive factor of the priori signal-to-noise ratio of air conduction of the previous frame, a second recursive factor of the target posteriori signal-to-noise ratio and a third recursive factor of the signal-to-noise ratio of bone conduction;

S3133: calculating the priori signal-to-noise ratio of air-bone integration according to each signal-to-noise ratio and the recursive factor corresponding to each signal-to-noise ratio.

For example, in the operation of calculating the target posteriori signal-to-noise ratio, please continue to refer to Equation 3, in which $\widehat{\xi_{a2}}(l,k)$ is the target posteriori signal-to-noise ratio, $\widehat{\xi_{a2}}(l,k)=\max$ (the posteriori signal-to-noise ratio of air conduction of the current frame-1, 0). If the posteriori signal-to-noise ratio of air conduction of the current frame is $\widehat{\xi_0}(\ell,k)$, then $\widehat{\xi_{a2}}(\ell,k)=\max(\widehat{\xi_0}(l,k)-1,0)$. That is, the target posteriori signal-to-noise ratio is the maximum value between the posteriori signal-to-noise ratio $\widehat{\xi_0}(\ell,k)$ of air conduction of the current frame-1 and 0.

For another example, in the operation of calculating the priori signal-to-noise ratio of air-bone integration, please refer to Equation 10:

$$\widehat{\xi_{a2}}(\ell,k)=\beta_1(\ell,k)\cdot\ell(l-1,k)+\beta_2(\ell,k)\cdot\widehat{\xi_{a2}}(\ell,k)+\beta_3(\ell,k)\cdot\hat{\psi}(\ell,k),\ 0\leq k\leq k_b$$

wherein $\beta_1(l,k)$ is the first recursive factor of priori signal-to-noise ratio of air conduction of the previous frame of the kth frequency point in the lth frame, $\beta_2(l,k)$ is the second recursive factor of the target posteriori signal-to-noise ratio of the kth frequency point in the lth frame, $\beta_3(l,k)$ is the third recursive factor of the signal-to-noise ratio of bone conduction of the kth frequency point in the lth frame, $\hat{\psi}(l,k)$ is the signal-to-noise ratio of bone conduction of the kth frequency point in the lth frame, and $\widehat{\xi_{a2}}(l,k)$ is the priori signal-to-noise ratio of air-bone integration of the kth frequency point in the lth frame.

Therefore, the earphone may calculate the priori signal-to-noise ratio of air-bone integration according to each signal-to-noise ratio and the recursive factor corresponding to each signal-to-noise ratio.

In some embodiments, each recursive factor is obtained by integrating the priori signal-to-noise ratio of air conduction of the previous frame, the posteriori signal-to-noise ratio of air conduction of the current frame and the signal-to-noise ratio of bone conduction. For example, the first recursive factor, the second recursive factor or the third recursive factor are all obtained by integrating the priori signal-to-noise ratio of air conduction of the previous frame, the posteriori signal-to-noise ratio of air conduction of the current frame and the signal-to-noise ratio of bone conduction. Therefore, when the air conduction parameters of the current frame, or the air conduction noise parameters of the current frame, or the bone conduction parameters of the current frame, or the ratio of the air conduction parameters of the current frame to the bone conduction parameters of the current frame, or the ratio of the air conduction noise parameters of the current frame to the bone conduction parameters of the current frame show a change, they can all be reflected on each recursive factor, so that the earphone can adaptively adjust each recursive factor according to the above changes. In this way, when the bone conduction signal and the air conduction signal can be seamlessly integrated, the noise can also be effectively reduced.

In some embodiments, the sum of the first recursive factor, the second recursive factor and the third recursive factor is the natural number 1.

In some embodiments, the third recursive factor is of a positive correlation with the air conduction noise parameter of the current frame. That is, the larger the air conduction noise parameter of the current frame is, the larger the third recursive factor will be, and the greater the proportion of signal-to-noise ratio of bone conduction in the priori signal-to-noise ratio of air-bone integration will be. On the contrary, the smaller the air conduction noise parameter in the current frame is, the smaller the third recursive factor will be, and the smaller the proportion of signal-to-noise ratio of bone conduction in the priori signal-to-noise ratio of air-bone integration will be.

Generally, a larger environmental noise is more likely to cause the distortion of human voice. Especially when the priori signal-to-noise ratio of air conduction is small, the noise reduction is not thorough enough, so it is easy to leave redundant noise. The bone conduction signal is used to raise or lower the priori signal-to-noise ratio of air-bone integration within the effective signal range because the bone conduction signal is not affected by environmental noise. That is, the priori signal-to-noise ratio of air-bone integration can be reliably and effectively adjusted by using the bone conduction signal, so that the priori signal-to-noise ratio of air-bone integration can be positively correlated with the environmental noise, and the noise-reduced signal output by the earphone at the later stage according to the priori signal-to-noise ratio of air-bone integration can be positively correlated with the environmental noise, thereby avoiding human voice distortion or effectively suppressing noise.

In some embodiment, the third recursive factor is set to be of a positive correlation with the air conduction noise parameters of the current frame, so that the signal-to-noise ratio of bone conduction and the action result of the third recursive factor are also positively correlated, and thus the priori signal-to-noise ratio of air-bone integration can be adjusted positively and adaptively, and the noise can be filtered for the later stage and the definition of human voice can be improved.

In some embodiments, the first recursive factor is greater than the second recursive factor and the third recursive factor. Please continue to refer to Equation 10, wherein $\beta_1(l,k)>\beta_2(l,k)$, $\beta_1(l,k)>\beta_3(l,k)$.

Usually, in the process of noise reduction, if the noise-reduced signals of two adjacent frames suddenly change or change too steeply, this phenomenon will greatly affect the smoothness of the noise-reduced signals and make the noise-reduced signals heard by users unnatural. Therefore, the earphone may be designed such that the first recursive factor is larger than the second recursive factor, and the first recursive factor is larger than the third recursive factor. The priori signal-to-noise ratio of air-bone integration mainly depends on the priori signal-to-noise ratio of air conduction of the previous frame, because the first recursive factor is related to the priori signal-to-noise ratio of air conduction of the previous frame, In order to ensure the smooth transition between the priori signal-to-noise ratio of air-bone integration of the previous frame and the priori signal-to-noise ratio of air-bone integration of the current frame, and avoid sudden change, the first recursive factor may be designed to be larger than the second recursive factor and the third recursive factor, so that the result of the priori signal-to-noise ratio of air conduction in the previous frame and the first recursive factor can always occupy the dominant position to avoid sudden increase or decrease due to the change of environmental noise, thereby realizing the smooth transition of noise-reduced signals in two adjacent frames.

In some embodiments, on the premise of ensuring the smoothness of the noise-reduced signal, as mentioned above, the bone conduction signal is not affected by environmental noise. Therefore, in order to enhance the influence of the bone conduction signal on the priori signal-to-noise ratio of air-bone integration within the effective signal range, the third recursive factor may be designed to be larger than the second recursive factor so as to enhance the influence of the result of the signal-to-noise ratio of bone conduction and the third recursive factor on the priori signal-to-noise ratio of air-bone integration, which is beneficial for improving the noise reduction effect.

Figure 6:
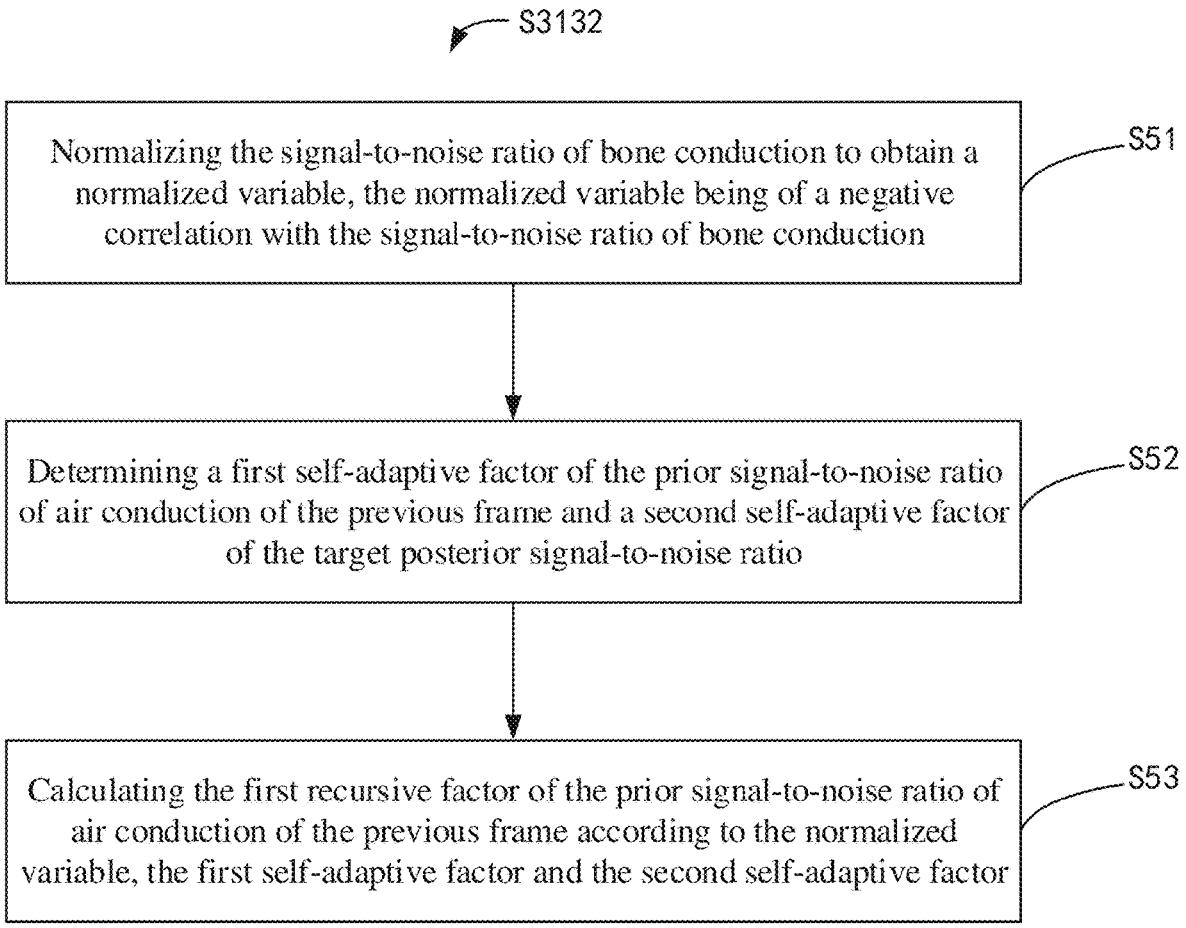
FIG. 6 is a schematic flowchart diagram of S3132 shown in FIG. 5.

In some embodiments, referring to FIG. 6, S3132 includes:

S51: normalizing the signal-to-noise ratio of bone conduction to obtain a normalized variable, the normalized variable being of a negative correlation with the signal-to-noise ratio of bone conduction;

S52: determining a first self-adaptive factor of the priori signal-to-noise ratio of air conduction of the previous frame and a second self-adaptive factor of the target posteriori signal-to-noise ratio;

S53: calculating the first recursive factor of the priori signal-to-noise ratio of air conduction of the previous frame according to the normalized variable, the first self-adaptive factor and the second self-adaptive factor.

For example, please continue to refer to Equation 8, because:

$$\hat{\psi}(\ell,k)=|\widehat{B_S}(\ell,k)|^2/\widehat{\sigma_N^2}(\ell,k),\ 0<k\leq k_b$$

As can be known from Equation 8, the larger the signal-to-noise ratio $\hat{\psi}(l,k)$ of bone conduction is, the smaller the environmental noise signal will be as compared to the bone conduction signal under the current environmental noise, and the signal-to-noise ratio $\hat{\psi}(l,k)$ of bone conduction may be used to measure the influence of the environmental noise on the whole voice signal. Therefore, in this embodiment, because the values of the recursive factors all range from 0 to 1, and the signal-to-noise ratio $\hat{\psi}(l,k)$ of bone conduction is negatively correlated with the power parameter $\widehat{\sigma_N^2}(l,k)$ of the air conduction noise spectrum, in order to integrate the signal-to-noise ratio $\hat{\psi}(l,k)$ of bone conduction into voice noise reduction, this embodiment normalizes the signal-to-noise ratio of bone conduction to map the signal-to-noise ratio $\hat{\psi}(l,k)$ of bone conduction between 0 and 1, i.e., to perform normalizing processing. Moreover, this embodiment hopes that the mapped variables can follow the following negative correlation relationships: the larger the power parameter $\widehat{\sigma_N^2}(l,k)$ of the air conduction noise spectrum is, the smaller the signal-to-noise ratio $\hat{\psi}(l,k)$ of bone conduction will be, and the larger the normalized variable will be; and the smaller the power parameter $\widehat{\sigma_N^2}(l,k)$ of air conduction noise spectrum is, the larger the signal-to-noise ratio $\hat{\psi}(l,k)$ of bone conduction will be, and the smaller the normalized variable will be.

In some embodiments, S51 includes: normalizing the signal-to-noise ratio of bone conduction according to Equation 11 to obtain a normalized variable, wherein Equation 11 is:

$$\widehat{\rho_\psi}(\ell,k)=\tanh(-\hat{\psi}(\ell,k))+1,\ 0<k\leq k_b \qquad \text{Equation 11}$$

In this embodiment, the signal-to-noise ratio of bone conduction is inverted, and then the inverted signal-to-noise ratio of bone conduction is mapped by hyperbolic tangent function tanh, wherein $\widehat{\rho_\psi}(l,k)$ is the normalized variable of the kth frequency point in the lth frame.

In some embodiments, the first self-adaptive factor $a_1(l,k)$ of the priori signal-to-noise ratio of air conduction of the previous frame is:

$$a_1(\ell, k) = \frac{1}{1 + \left(\frac{\xi_a(\ell, k) - \hat{\xi}_{a1}(\ell - 1, k)}{\xi_a(\ell, k)}\right)^2} \quad \text{Equation 12}$$

As can be known from Equation 12, $a_1(l,k)$ is the self-adaptive recursive factor for measuring the error between $\xi_a(l,k)$ and $\ell(l-1, k)$ and the value of the $\xi_a(l,k)$ itself, then $\widehat{\rho_\psi}(l,k)$ and $a_1(l,k)$ may be used in combination as the self-adaptive recursive factor of the priori signal-to-noise ratio, so as to integrate the bone conduction signal in the priori signal-to-noise ratio estimation.

As can be known from Equation 4, $\widehat{\xi_{a2}}(l,k)$ is not only related to $\widehat{\xi_{a2}}(l,k)$ of the current frame, but also related to $\ell(l-1, k)$ the previous frame, and $\ell(l-1, k)$ generally accounts for a large proportion due to the consideration of recursive smoothing. Therefore, in order to better integrate the signal-to-noise ratio of bone conduction, the second self-adaptive factor $a_2(l,k)$ of the target posteriori signal-to-noise ratio is introduced in this embodiment, wherein the second self-adaptive factor $a_2(l,k)$ is:

$$a_2(\ell, k) = \frac{1}{1 + \left(\frac{\xi_a(\ell, k) - \hat{\xi}_{a1}(\ell - 1, k)}{\xi_a(\ell, k) + \varepsilon}\right)^2}, \; 0 < k \le k_b \quad \text{Equation 13}$$

Therefore, the earphone may calculate the first recursive factor $\beta_1(l,k)$ of the priori signal-to-noise ratio of air conduction of the previous frame according to the normalized variable, the first self-adaptive factor and the second self-adaptive factor. In some embodiments, the first recursive factor $\beta_1(l,k)$ is:

$$\beta_1(\ell, k_b) = [1 - \widehat{\mathcal{B}_S}(\ell, k)] \cdot a_2(\ell, k) + \widehat{\mathcal{B}_S}(\ell, k) \cdot a_1(\ell, k), \; 0 < k \le k_b \quad \text{Equation 14}$$

As can be known from the above equation, the normalized variable is related to the air conduction noise parameters of the current frame and the bone conduction parameters of the current frame, the first self-adaptive factor and the second self-adaptive factor are both related to the priori signal-to-noise ratio of air conduction of the previous frame and the posteriori signal-to-noise ratio of air conduction of the current frame, and the priori signal-to-noise ratio of air conduction of the previous frame and the posteriori signal-to-noise ratio of air conduction of the current frame are both related to the air conduction noise parameters of the current frame and the air conduction parameters of the current frame. Therefore, the first recursive factor $\beta_1(l,k)$ has skillfully integrated the bone conduction parameters of the current frame with the air conduction parameters of the current frame for calculation, which subsequently can change adaptively according to the bone conduction parameters of the current frame, the air conduction parameters of the current frame and the air conduction noise parameters of the current frame.

In addition, there is little difference between the first self-adaptive factor $a_1(l,k)$ and the second self-adaptive factor $a_2(l,k)$. If the second self-adaptive factor $a_2(l,k)$ is approximately regarded as the first self-adaptive factor $a_1(l,k)$, then the first recursive factor $\beta_1(l,k)$ is approximately equal to 1. In fact, the first recursive factor $\beta_1(l,k)$ usually ranges from 0.92 to 0.99. Therefore, as can be known from Equation 14, this embodiment can not only relate the first self-adaptive factor $a_1(l,k)$, the second self-adaptive factor $a_2(l,k)$ and the normalized variable $\widehat{\mathcal{B}_S}(l,k)$, but also ensure that $\beta_1(l,k) \cdot \ell(l-1, k)$ occupies a large proportion in $\widehat{\xi_{a2}}(l,k)$ as can be known from Equation 10. Furthermore, since $\ell(l-1, k)$ is the priori signal-to-noise ratio of air conduction of the previous frame, and $\widehat{\xi_{a2}}(l,k)$ is priori signal-to-noise ratio of air-bone integration, smooth transition of noise-reduced signals in two adjacent frames is ensured.

In some embodiments, in the operation of determining the second recursive factor of the target posteriori signal-to-noise ratio, S3132 includes calculating the second recursive factor of the target posteriori signal-to-noise ratio according to the normalized variable and the second self-adaptive factor.

In some embodiments, the second recursive factor $\beta_2(l,k)$ is:

$$\beta_2(\ell, k) = [1 - \widehat{\mathcal{B}_S}(\ell, k)] \cdot [1 - a_2(\ell, k)], \; 0 < k \le k_b \quad \text{Equation 15}$$

As can be known from Equation 15, when the air conduction noise parameter of the current frame decreases, the normalized variable $\widehat{\mathcal{B}_S}(l,k)$ decreases and the second recursive factor $\beta_2(l,k)$ increases. This indicates that the compensation of bone conduction signal may be appropriately reduced and the proportion of air conduction signal may be increased due to the relatively small environmental noise. When the air conduction noise parameter of the current frame increases, the normalized variable $\widehat{\mathcal{B}_S}(l,k)$ increases and the second recursive factor $\beta_2(l,k)$ decreases. This indicates that the compensation of bone conduction signal may be appropriately improved and the proportion of air conduction signal may be reduced due to the relatively large environmental noise.

In some embodiments, in the operation of determining the third recursive factor of the signal-to-noise ratio of bone conduction, S3132 includes calculating the third recursive factor of the signal-to-noise ratio of bone conduction according to the normalized variable and the first self-adaptive factor.

In some embodiments, the third recursive factor $\beta_3(l,k)$ is:

$$\beta_3(\ell, k) = \widehat{\mathcal{B}_S}(\ell, k) \cdot [1 - a_1(\ell, k)], \; 0 < k \le k_b \quad \text{Equation 16}$$

$$\beta_1(\ell, k) + \beta_2(\ell, k) + \beta_3(\ell, k) = 1, \; 0 < k \le k_b \quad \text{Equation 17}$$

As can be known from Equation 16, when the air conduction noise parameter of the current frame decreases, the normalized variable $\widehat{\mathcal{B}_S}(l,k)$ decreases and the third recursive factor $\beta_3(l,k)$ decreases. This indicates that the compensation of bone conduction signal may be appropriately reduced and the proportion of air conduction signal may be increased due to the relatively small environmental noise. When the air conduction noise parameter of the current frame increases, the normalized variable $\widehat{\mathcal{B}_S}(l,k)$ increases and the third recursive factor $\beta_3(l,k)$ increases. This indicates that the compensation of bone conduction signal may be appropriately improved and the proportion of air conduction signal may be improved due to the relatively large environmental noise.

Figure 7:
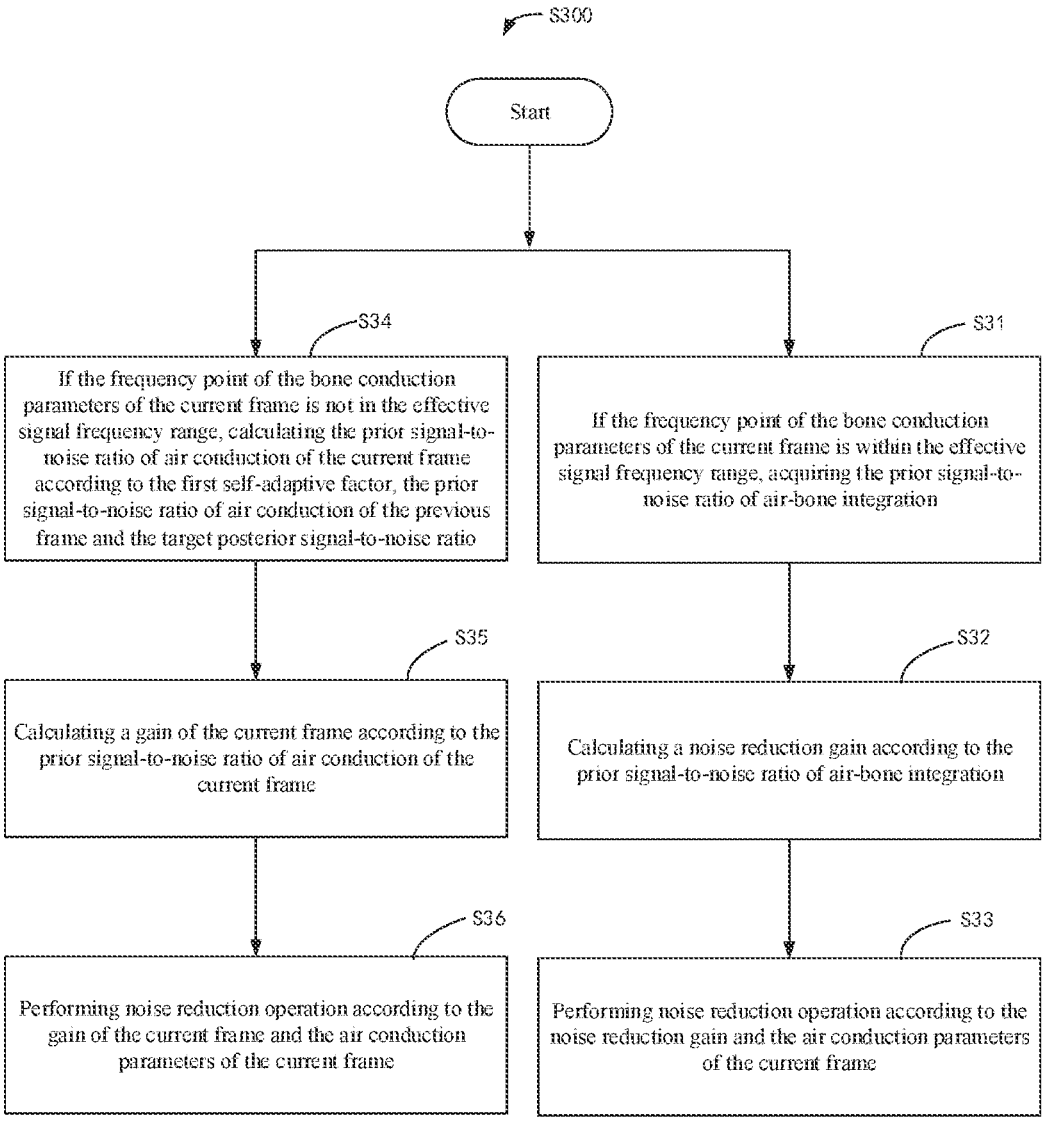
FIG. 7 is a schematic flowchart diagram of a noise reduction method provided according to another embodiment of the present disclosure.

In some embodiments, referring to FIG. 7, the noise reduction method S300 further includes:

S34: calculating the priori signal-to-noise ratio of air conduction of the current frame according to the first self-adaptive factor, the priori signal-to-noise ratio of air conduction of the previous frame and the target posteriori signal-to-noise ratio, if the frequency point of the bone conduction parameters of the current frame is not in the effective signal frequency range;

S35: calculating a gain of the current frame according to the priori signal-to-noise ratio of air conduction of the current frame;

S36: performing noise reduction operation according to the gain of the current frame and the air conduction parameters of the current frame.

S31 specifically includes: if the frequency point of the bone conduction parameters of the current frame is within the effective signal frequency range, acquiring the priori signal-to-noise ratio of air-bone integration.

In some embodiments, the effective signal frequency range is the frequency range where the bone conduction signal integrated to the priori signal-to-noise ratio of air-bone integration is located. According to the physical characteristics of the bone conduction signal, the bone conduction signal may compensate for the air conduction signal in a low frequency band. Generally, the effective signal frequency range is 0 to 1000 Hz.

If the frequency point of the bone conduction parameters of the current frame is not in the effective signal frequency range, the earphone will not use the bone conduction signal to compensate for the air conduction signal. If the frequency point of the bone conduction parameters of the current frame is not within the effective signal frequency range, the earphone calculates the priori signal-to-noise ratio of air conduction of the current frame according to the first self-adaptive factor, the priori signal-to-noise ratio of air conduction of the previous frame and the target posteriori signal-to-noise ratio. For example, please continue to refer to Equation 1, and the earphone may calculate the priori signal-to-noise ratio of air conduction of the current frame in combination with the Equation 1.

Herein, cases where the frequency points of bone conduction parameters in the current frame are not in the effective signal frequency range or are in the effective signal frequency range are summarized as follows:

$$\begin{cases} \hat{\xi}_a(\ell, k) = \beta_1(\ell, k)\cdot\hat{\xi}_{a1}(\ell-1, k) + \beta_2(\ell, k)\cdot\hat{\xi}_{a2}(\ell, k) + \beta_3(\ell, k)\cdot\hat{\psi}(\ell, k), \text{ if } 0 \le k \le k_b \\ \hat{\xi}_a(\ell, k) = a_1(\ell, k)\cdot\hat{\xi}_{a1}(\ell-1, k) + (1 - a_1(\ell, k))\cdot\hat{\xi}_{a2}(\ell, k), \text{ else} \end{cases}$$

Therefore, the earphone can not only compensate for the air conduction signal with bone conduction signal in the effective signal frequency range for noise reduction, but also reduce the noise of the air conduction signal that is not in the effective signal frequency range.

In order to express the noise reduction effect of the noise reduction method provided in this embodiment, description will be made herein with reference to FIG. 8 to FIG. 10. In the coordinate system of each figure, the abscissa represents time, the ordinate represents frequency, fine dots in light dark gray of each figure are noise, and the clusters of white and bright areas composed of bright white dots are normal voice.

As the bone conduction signal involved in the noise reduction method provided in this embodiment is the bone conduction signal within the effective frequency range, in order to express the noise reduction effect more effectively, the speech spectrum of 200 Hz to 800 Hz may be selected in each figure for explanation.

Figure 8:
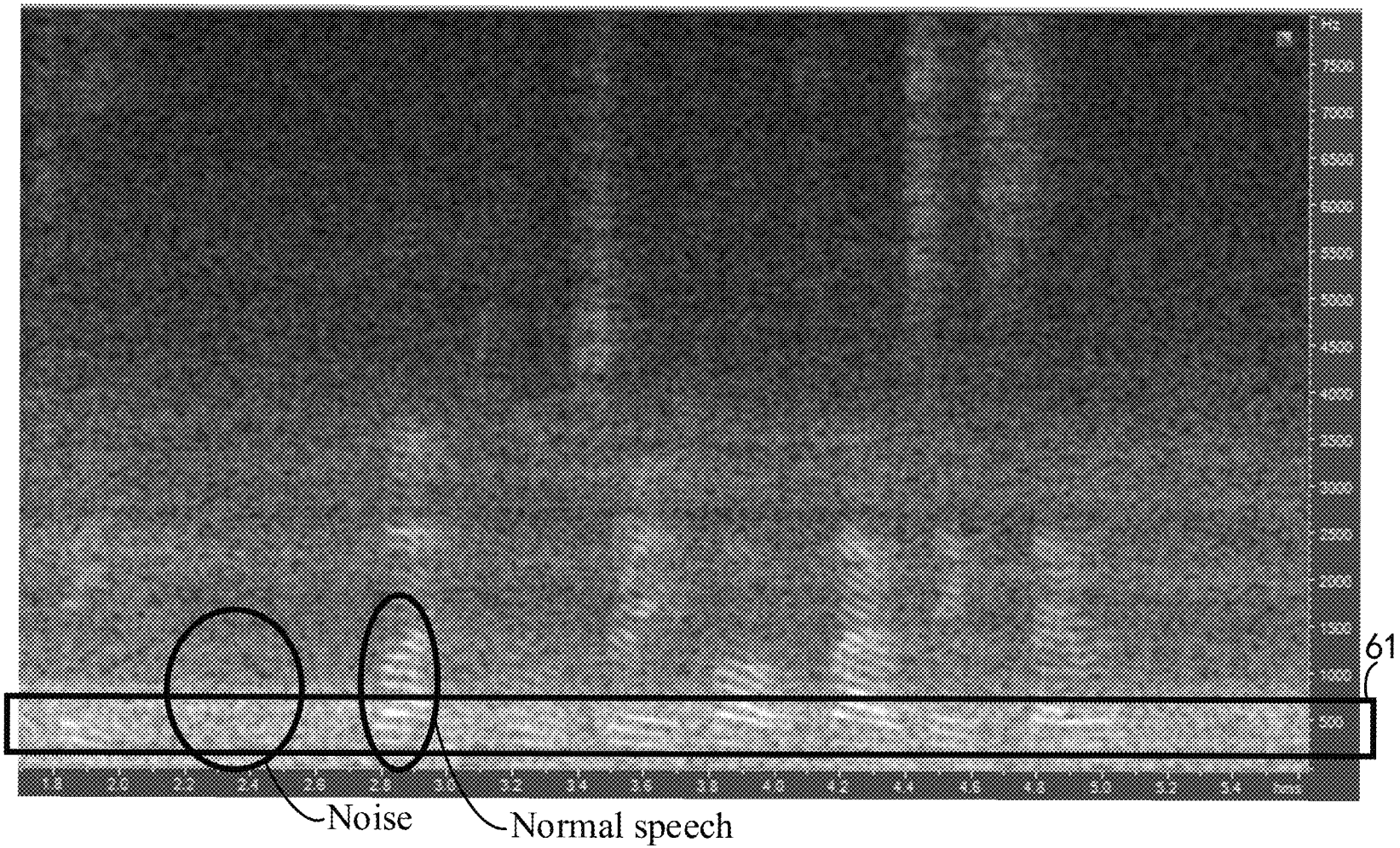
FIG. 8 is a schematic view of a noisy speech spectrum provided according to an embodiment of the present disclosure, wherein noise reduction operation has not been performed on the noisy speech spectrum.

In FIG. 8, the speech spectrum area 61 includes noise and normal speech. As can be known from FIG. 8, between 200 Hz and 800 Hz, the noise is scattered in the normal speech at various time points.

Figure 9:
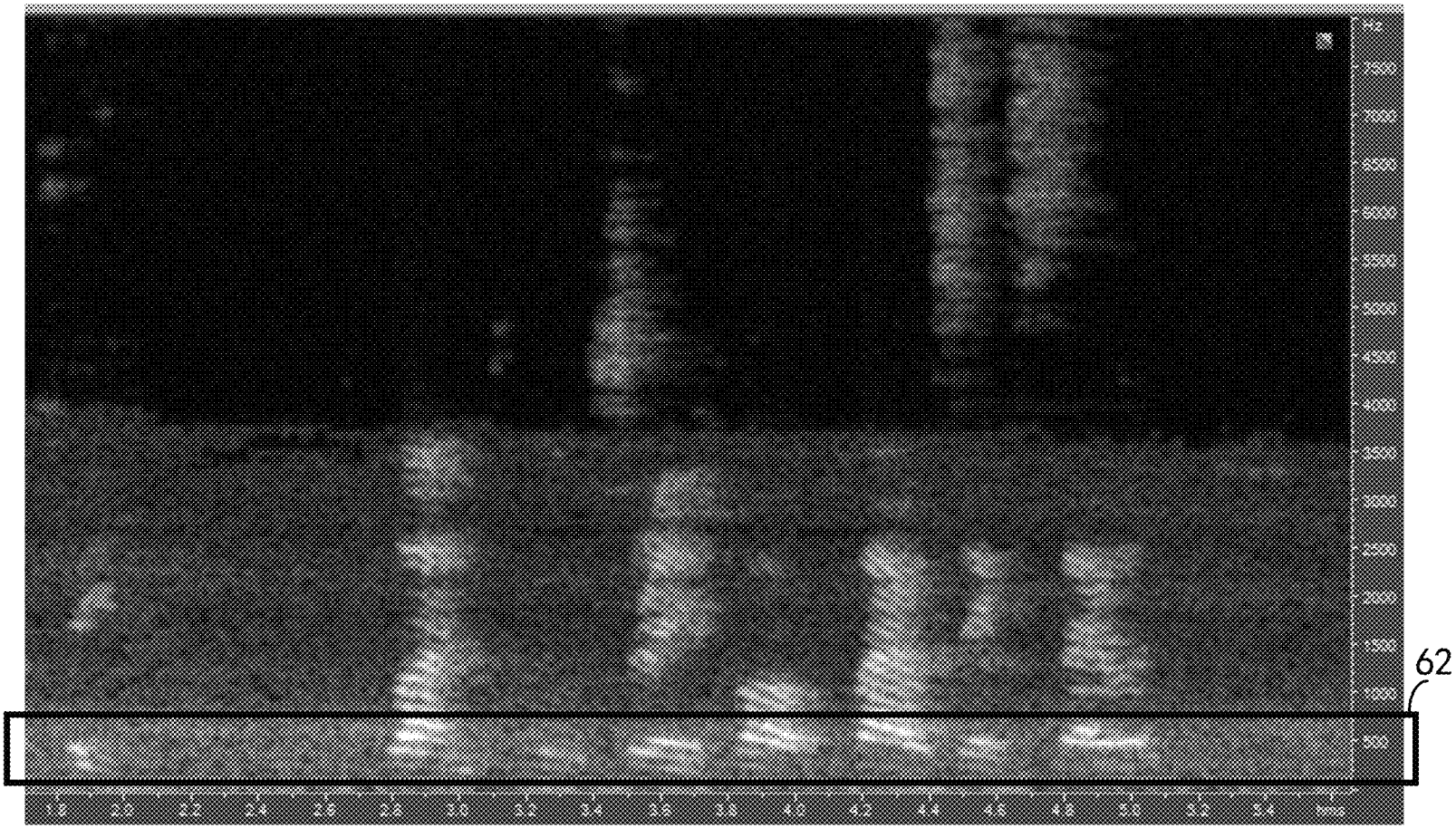
FIG. 9 is a schematic view of the noisy speech spectrum shown in FIG. 8 after noise reduction by using the conventional noise reduction method based on air conduction single channel.

In FIG. 9, the speech spectrum area 62 includes noise and normal speech. As can be known from FIG. 9, as compared to the speech spectrum area 61 of FIG. 8, between 200 Hz and 800 Hz, some noises remain although some noises are filtered. In addition, the normal speech between 200 Hz and 800 Hz is also filtered, especially in the partial speech spectrum close to 200 Hz, and voice distortion is more likely to occur when this phenomenon is more obvious.

Figure 10:
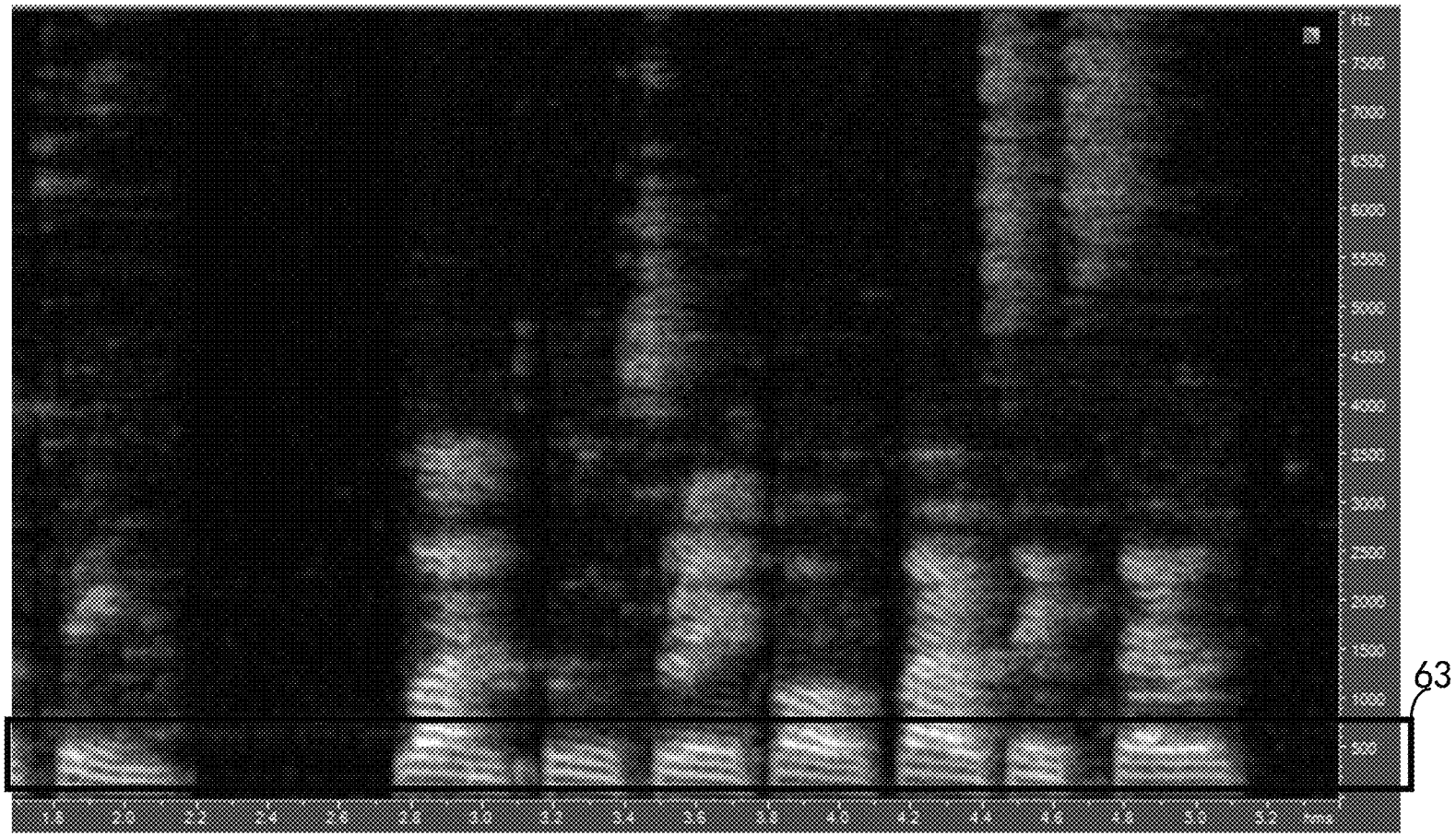
FIG. 10 is a schematic view of the noisy speech spectrum shown in FIG. 8 after noise reduction by using the noise reduction method provided in this embodiment.

In FIG. 10, the speech spectrum area 63 includes noise and normal speech. As can be known from FIG. 10, as compared to the speech spectrum area 62 in FIG. 9, most of the noise is filtered between 200 Hz and 800 Hz. In addition, the normal speech between 200 Hz and 800 Hz is almost preserved, especially in the partial speech spectrum near 200 Hz, and the probability of voice distortion is reduced when the preservation phenomenon is more obvious.

It should be noted that, in each of the above embodiments, the above steps are not necessarily executed in a certain order. According to the description of the embodiments of the present disclosure, those of ordinary skill in the art may understand that in different embodiments, the above steps may be executed in different orders. That is, these steps may be executed in parallel or the steps may be exchanged for execution, and so on.

Figure 11:
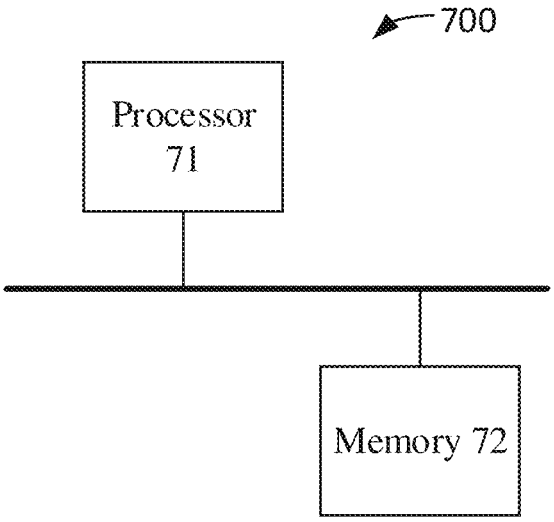
FIG. 11 is a schematic view of a circuit structure of an electronic equipment provided according to an embodiment of the present disclosure.

Please refer to FIG. 11, which is a schematic view of a circuit structure of an electronic equipment provided according to an embodiment of the present disclosure, wherein the electronic equipment may be electronic products such as a chip. As shown in FIG. 11, an electronic equipment 700 includes one or more processors 71 and a memory 72. In FIG. 11, one processor 71 is taken as an example.

The processor 71 and the memory 72 may be connected by a bus or other means, and the connection achieved by a bus is taken as an example in FIG. 11.

As a nonvolatile computer readable storage medium, the memory 72 may be used to store nonvolatile software programs, nonvolatile computer executable programs and modules, such as program instructions/modules corresponding to the noise reduction method in the embodiment of the present disclosure. The processor 71 performs various function applications of the noise reduction device and data processing, i.e., achieves the noise reduction method provided according to the above embodiments of the method and functions of various modules or units of the above embodiments of the device by running nonvolatile software programs, instructions and modules stored in the memory 72.

The memory 72 may include a high-speed random access memory, and may also include a nonvolatile memory, such as at least one magnetic disk memory device, flash memory device, or other nonvolatile solid-state memory device. In some embodiments, the memory 72 optionally includes memories remotely located relative to the processor 71, and these remote memories may be connected to the processor 71 through a network. Examples of the above network include but are not limited to the Internet, Intranet, local area networks, mobile communication networks and combinations thereof.

The program instructions/modules are stored in the memory 72, and when executed by the one or more processors 71, execute the noise reduction method in any of the above embodiments of the method.

An embodiment of the present disclosure further provides a nonvolatile computer storage medium, in which computer executable instructions are stored. The computer executable instructions, when executed by one or more processors, e.g., a processor 71 in FIG. 11, cause the one or more processors to execute the noise reduction method in any of the above embodiments of the method.

An embodiment of the present disclosure further provides a computer program product, which includes a computer program stored on a nonvolatile computer readable storage medium, and the computer program includes program instructions. The program instructions, when executed by an electronic equipment, cause the electronic equipment to execute any of the noise reduction methods.

The embodiments of the above-described devices or equipments are only schematic. The unit modules described as separate components may or may not be physically separated, and components displayed as module units may or may not be physical units, that is, they may be located in one place or distributed over multiple network module units. Some or all of the modules may be selected according to actual needs to achieve the purpose of this embodiment.

From the description of the above embodiments, those skilled in the art may clearly understand that each embodiment may be realized by means of software plus a general hardware platform, and of course, it may also be realized by hardware. Based on such understanding, the essence of the above technical solution or the part that contributes to related technologies may be embodied in the form of software products. The computer software products may be stored in computer-readable storage media, such as a ROM/RAM, a magnetic disk, an optical disk or the like, and they include several instructions to make a computer equipment (which may be a personal computer, a server, or a network equipment, etc.) execute the method described in various embodiments or some parts of embodiments.

Finally, it shall be noted that, the above embodiments are only used to illustrate the technical solution of the present disclosure, but not to limit the present disclosure. Under the concept of the present disclosure, technical features in the above embodiments or different embodiments may also be combined, the steps may be realized in any order, and many other variations in different aspects of the present disclosure as described above are possible, and these variations are not provided in details for conciseness. Although the present disclosure has been described in detail with reference to the foregoing embodiments, those of ordinary skill in the art shall appreciate that, the technical solutions described in the foregoing embodiments may still be modified or some of the technical features may be equivalently replaced. These modifications or substitutions do not make the essence of the corresponding technical solutions deviate from the scope of the technical solutions of various embodiment of the present disclosure.

What is claimed is:

1. A method for reducing noise, comprising:

providing a current frame having air conduction parameters, bone conduction parameters and air conduction noise parameters;

obtaining a priori signal-to-noise ratio of air-bone integration, the priori signal-to-noise ratio of air-bone integration being obtained by integrating the air conduction parameters, the bone conduction parameters and the air conduction noise parameters;

calculating a noise reduction gain according to the priori signal-to-noise ratio of air-bone integration; and performing noise reduction operation according to the noise reduction gain and the air conduction parameters of the current frame.

2. The method of claim 1, wherein the obtaining a priori signal-to-noise ratio of air-bone integration comprises:

calculating a priori signal-to-noise ratio of air conduction of a previous frame and a posteriori signal-to-noise ratio of air conduction of the current frame respectively according to the air conduction parameters of the current frame and the air conduction noise parameters of the current frame;

calculating the signal-to-noise ratio of bone conduction according to the bone conduction parameters of the current frame and the air conduction noise parameters of the current frame; and obtaining the priori signal-to-noise ratio of air-bone integration by integrating the priori signal-to-noise ratio of air conduction of the previous frame, the posteriori signal-to-noise ratio of air conduction of the current frame and the signal-to-noise ratio of bone conduction.

3. The method of claim 2, wherein the bone conduction parameters of the current frame are obtained by integrating bone conduction sound signals and the gain of bone conduction sound signals.

4. The method of claim 2, wherein the signal-to-noise ratio of bone conduction is of a negative correlation with the air conduction noise parameters of the current frame.

5. The method of claim 2, wherein the obtaining the priori signal-to-noise ratio of air-bone integration by integrating the priori signal-to-noise ratio of air conduction of the previous frame, the posteriori signal-to-noise ratio of air conduction of the current frame and the signal-to-noise ratio of bone conduction comprises:

calculating a target posteriori signal-to-noise ratio according to the posteriori signal-to-noise ratio of air conduction of the current frame;

determining a first recursive factor of the priori signal-to-noise ratio of air conduction of the previous frame, a second recursive factor of the target posteriori signal-to-noise ratio and a third recursive factor of the signal-to-noise ratio of bone conduction;

calculating the priori signal-to-noise ratio of air-bone integration according to each signal-to-noise ratio and the recursive factor corresponding to each signal-to-noise ratio.

6. The method of claim 5, wherein the calculating a target posteriori signal-to-noise ratio according to the posteriori signal-to-noise ratio of air conduction of the current frame comprises:

obtaining the result of subtraction by subtracting the posteriori signal-to-noise ratio of air conduction of the current frame with the natural number 1;

selecting the maximum value between the result of subtraction and the natural number 0.

7. The method of claim 5, wherein the sum of the first recursive factor, the second recursive factor and the third recursive factor is the natural number 1.

8. The method of claim 5, wherein each recursive factor is obtained by integrating the priori signal-to-noise ratio of air conduction of the previous frame, the posteriori signal-to-noise ratio of air conduction of the current frame and the e signal-to-noise ratio of bone conduction.

9. The method of claim 5, wherein the third recursive factor is of a positive correlation with the air conduction noise parameters of the current frame.

10. The method of claim 5, wherein the first recursive factor is greater than the second recursive factor and the third recursive factor.

11. The method of claim 10, wherein the third recursive factor is greater than the second recursive factor.

12. The method of claim 5, wherein the determining the first recursive factor of the priori signal-to-noise ratio of air conduction of the previous frame comprises:

normalizing the signal-to-noise ratio of bone conduction to obtain a normalized variable, and the normalized variable being of a negative correlation with the signal-to-noise ratio of bone conduction;

determining a first self-adaptive factor of the priori signal-to-noise ratio of air conduction of the previous frame and a second self-adaptive factor of the target posteriori signal-to-noise ratio; and calculating the first recursive factor of the priori signal-to-noise ratio of air conduction of the previous frame according to the normalized variable, the first self-adaptive factor and the second self-adaptive factor.

13. The method of claim 12, wherein the determining the second recursive factor of the target posteriori signal-to-noise ratio comprises:

calculating the second recursive factor of the target posteriori signal-to-noise ratio according to the normalized variable and the second self-adaptive factor.

14. The method of claim 12, wherein the determining the third recursive factor of the signal-to-noise ratio of bone conduction comprises:

calculating the third recursive factor of the signal-to-noise ratio of bone conduction according to the normalized variable and the first self-adaptive factor.

15. The method of claim 12, wherein the method further comprises:

calculating the priori signal-to-noise ratio of air conduction of the current frame according to the first self-adaptive factor, the priori signal-to-noise ratio of air conduction of the previous frame and the target posteriori signal-to-noise ratio, if the frequency point of the bone conduction parameters of the current frame is not in the effective signal frequency range;

calculating a gain of the current frame according to the priori signal-to-noise ratio of air conduction of the current frame; and performing noise reduction operation according to the gain of the current frame and the air conduction parameters of the current frame.

16. The method of claim 12, wherein the normalized variable is of a negative correlation with the second recursive factor.

17. The method of claim 12, wherein the normalized variable is of a positive correlation with the third recursive factor.

18. A chip, comprising:

at least one processor; and a memory communicatively connected with the at least one processor;

wherein the memory stores instructions that when executed by the at least one processor cause the at least one processor to perform the method of claim 1.

19. An electronic equipment, comprising:

at least one processor; and a memory communicatively connected with the at least one processor;

wherein the memory stores instructions that when executed by the at least one processor cause the at least one processor to perform the method of claim 1.

* * * * *